United States Patent [19]
Handel et al.
[11] 4,353,069
[45] Oct. 5, 1982

[54] ABSORPTIVE COATING FOR THE REDUCTION OF THE REFLECTIVE CROSS SECTION OF METALLIC SURFACES AND CONTROL CAPABILITIES THEREFOR

[76] Inventors: Peter H. Handel, 20 Roclare La., St. Louis, Mo. 63131; James A. Jungman, 611 Dougherty Terrace Dr., St. Louis, Mo. 63011; Stephen N. Honickman, 1870 Clover Ridge Ct., Chesterfield, Mo. 63017

[21] Appl. No.: 185,979

[22] Filed: Sep. 10, 1980
(Under 37 CFR 1.47)

[51] Int. Cl.[3] ..... H01Q 17/00
[52] U.S. Cl. ..... 343/18 A; 343/18 B
[58] Field of Search ..... 343/18 A, 18 B; 174/35 MS; 428/620

[56] References Cited

PUBLICATIONS

T.R.E. Report No. T. 1905, m/gg, Jul. 23, 1945, Declassified 2/14/60, "Radar Camouflage, Research & Development by the Germans", reproduced by the Armed Services Technical Information Agency, ATI 129880, G. G. Macfarlane, pp. 1–26.
"The Schornsteinfeyer Project", Technical Report No. 90–45, May 1945, declassifed 2/19/60, pp. 16–21.

*Primary Examiner*—Malcolm F. Hubler
*Attorney, Agent, or Firm*—Polster, Polster and Lucchesi

[57] ABSTRACT

An absorptive coating for reduction of the reflective cross section of a metallic surface is provided which includes a layer of "N" doped material adjacent the metal surface, the N doped material having a characteristic of increasing semiconductor conductivity from the outboard surface junction of the material to the boundary of the metallic surface, a second layer of "P" doped material having a characteristic of increasing semiconductor conductivity from its outboard surface boundary to its junction with the N doped material inboard of it. In the preferred embodiment, a third layer of P material is placed outboard of the second layer. The first and second layers further have electrical connections operatively associated with them, so that an applied voltage may be utilized to vary the electrical characteristics of the coating.

21 Claims, 4 Drawing Figures

ABSORPTIVE COATING FOR THE REDUCTION OF THE REFLECTIVE CROSS SECTION OF METALLIC SURFACES AND CONTROL CAPABILITIES THEREFOR

BACKGROUND OF THE INVENTION

This invention relates to coatings for the reduction of reflective cross sections of metallic surfaces, and in particular, to a compact, wide band radar absorptive coating preferably having tuning and control capabilities.

Various absorptive materials have been used in the past to reduce radar cross section of selective objects. However, the materials used in the past, and their application, have been dependent upon the wave length of the incident wave. That is to say, the absorptive qualities of previously known materials have required a considerable thickness of the material in order to perform its function. In general, known prior art material provides a maximum reduction of radar cross section of about 20 db per wave length thickness of the material utilized for absorptive purposes. Known materials also are functional only in a very narrow band of radar frequencies. Consequently, the usefulness of the absorptive materials is exceedingly limited. For example, they are not suitable for use on high performance aircraft because the thickness of material required to make the aircraft non-reflective is too great. That is to say, the thickness required to offer a significant reduction in the reflective cross section of the aircraft is so great as to render its application to the aircraft impractical, particularly in view of the operation speeds of such aircraft.

The invention disclosed hereinafter overcomes these prior deficiencies by providing a material structure which is capable both of passive and active application as a absorptive coating. The coating of this invention exhibits wide band performance and is theoretically capable of reducing radar cross section by approximately 40 db. At high frequencies, the material may be used in its passive mode, a relatively thin thickness of material alone being sufficent to provide the absorptive qualities. At low frequencies, means are provided for injecting a control voltage within the coating, thereby enabling the material to provide absorptive properties, even where the thickness of the applied coating is less than the wave length of the incident wave.

One of the objects of this invention is to provide an absorptive coating for electromagnetic wave energy having improved performance characteristics.

Another object of this invention is to provide an absorptive coating for electromagnetic wave energy capable of use in either an active or a passive mode.

Another object of this invention is to provide an absorptive coating for electromagnetic wave energy suitable for use over a wide range of incident wave frequencies.

Another object of this invention is to provide a coating for a metallic surface having a PN junction therein.

Still another object of this invention is to provide a coating in which a control voltage may be injected across a PN junction of a coating for a metallic surface.

Other objects of this invention will be apparent to those skilled in the art in light of the following description and accompanying drawings.

SUMMARY OF THE INVENTION

In accordance with this invention, generally stated, a coating for an incident wave reflecting surface is provided which includes an "N" doped layer material interposed between the reflecting surface and a "P" doped layer material so that a PN junction is provided in the coating. In its passive mode, the coating thickness is chosen to approximate the incident wave length and the layers are selected and arranged so that both conductivity and dielectric constant of the layers increases in a direction through the coating thickness toward the reflective surface to which the coating is applied. By attaching leads to the P doped and N doped layer portions of the coating, control voltages can be impressed to vary the electrical characteristics of the coating. In the embodiment illustrated, a third undoped layer coating is provided outboard of the first and second layers.

DESCRIPTION OF THE PREFERRED EMBODIMENT

Figure 1:
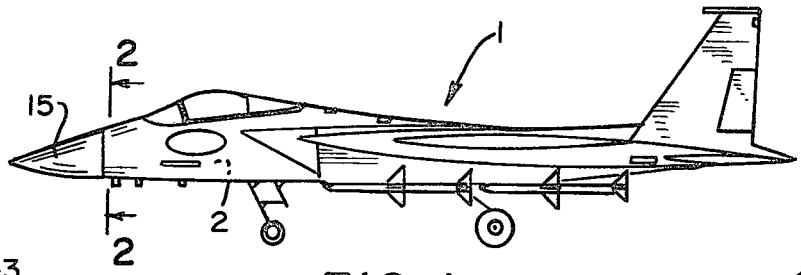
FIG. 1 is a view in side elevation of an aircraft employing coating of this invention.
Figure 2:
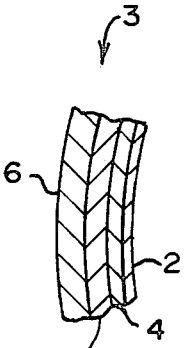
FIG. 2 is a sectional view, partly broken away, taken along the line 2—2 of FIG. 1.

Referring now to FIG. 1, reference numeral 1 indicates one illustrative embodiment of aircraft having an outer skin 2 or metallic surface of generally reflective material. As is well known in the art, a variety of materials are utilized for the skin 2 and neither the metallic surface 2 nor the operational aspects of the aircraft 1 form any part of the invention described hereinafter. It is here sufficient to note that the aircraft 1 generally may be a high performance aircraft in which it is desirable to either suppress reflective incident energy or change its characteristics upon reflection. In order to accomplish this end, we provide the aircraft with an absorptive coating 3. The coating 3 includes a first layer 4, a second layer 5, and a third layer 6. The layers 4, 5 and 6 are diagrammatically illustrated in FIG. 3 which further illustrates the properties of the particular coating which are required to accomplish the desired end of the invention.

Figure 3:
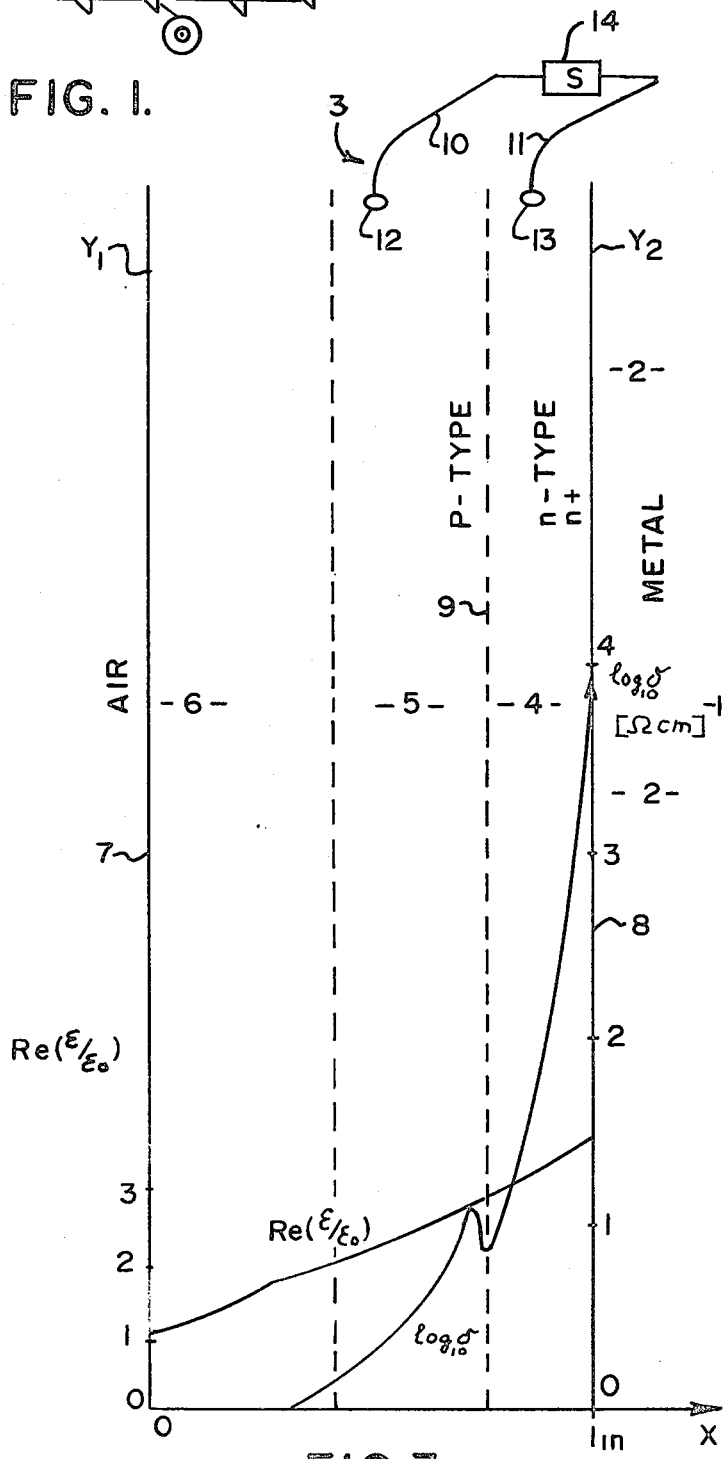
FIG. 3 is a enlarged, diagrammatic view of the coating shown in FIG. 2.

As shown in FIG. 3, a first Y axis 7 shows the dielectric constant of the material used in the coating 3 as a ratio $\epsilon$ divided by $\epsilon_o$ where $\epsilon$ is the dielectric constant of the particular material in question and $\epsilon_o$ is the dielectric constant of air. A second Y axis 8 depicts the conductivity of the material used in the coating 3, shown as the log to the base 10 of the conductivity in reciprocal ohms centimeter. The X axis depicts the material thickness in inches. As shown in FIG. 3, the dielectric material of the coating 3 is chosen so that the layer 6 has the lowest dielectric constant, the dielectric constant increasing through the layers 5 and 4. The conductivity of the layer 6 is chosen as 0 and the conductivity increases through the layer 5, exhibiting a characteristic dip at a PN junction 9. However, it increases substantially in the layer 4 to the boundary surface of the layer 5 and the metal 2. As indicated above, the layer 6 primarily serves as a protective layer. It may be used, however, to condition incoming electromagnetic wave energy to some extent so that the layers 4 and 5 better accomplish their function.

When coating 3 has a thickness of approximately one inch, the coating 3 will exhibit, in the passive mode of the coating operation, a broad frequency range absorptive characteristic. The one inch thickness of the coating 3 is useful against incident wave energy having a wave length not greater than the thickness of the coating. Thus, the coating 3 has an effective absorptive characteristic in its passive mode against a wide range of high frequency electromagnetic wave energy sources. When absorption of the incident wave requires a coating 3 thickness greater than approximately one inch, for example, when the electromagnetic wave originates at a low frequency source, the coating 3 may be used in an active mode to reduce reflected wave energy. Active mode operation is accomplished through the use of electrical leads 10 and 11, attached to the coating 3. The leads 10 and 11 are Ohmic contacts disposed periodically on the surface of the coating 3. As shown, the leads 10 and 11 are attached on opposite sides of the PN junction 9 at a pair of connection points 12 and 13, respectively. The leads 10 and 11 in turn are connected to a suitable source of electrical energy 14.

In the active mode of operation, the source 14 imposes an electrical signal across the PN junction 9, which alters the electrical characteristics of the coating 3, enabling the coating to act as an energy absorber even where low frequency wave energy impinges the coating. This is achieved by shaping the conductivity profile with the applied voltage such that the reflected wave is equal in amplitude and 180° out of phase with the incident wave, thus resulting in extinction of reflection at the outside surface of the coating.

As will be apparent to those skilled in the art, use of the coating 3 in an "active" mode has wide ranging implications for coating 3 use. For example, a relatively small thickness of material can be used over a broad range of incident wave frequencies by altering the electrical characteristics through injection of some predetermined voltage across the PN junction of the coating 3. Thus, a relatively thin coating of material on the surface 2 can achieve a significant reduction of reflective wave energy in active mode operation. Conversely, the reflected wave energy can be increased by selective application of the insertion voltage across the PN junction. That is to say, the reflected energy can be enhanced, if that is a desirable goal.

Figure 4:
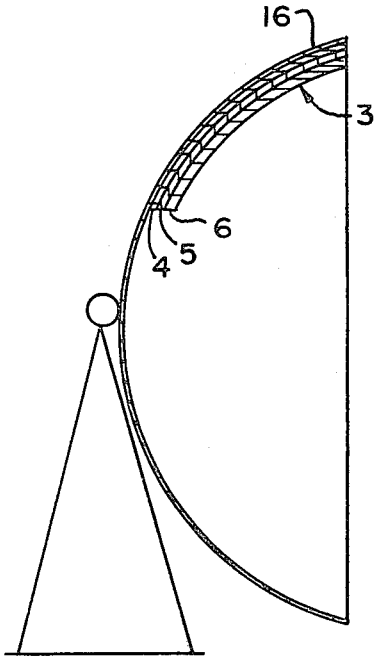
FIG. 4 is a antenna employing the coating of this invention.

The coating 3 may find application in a variety of applications. For example, in addition to being applied to the surface 2, the coating may be applied to a radome 15 of the aircraft 1, so that the radar tracking capabilities of the aircraft 1 itself are enhanced. That is to say, spurious energy reflection from the tracking radar of the aircraft 1 may be minimized by coating the radome 15 of the aircraft 1 in a predetermined manner, to enhance tracking capabilities along a particular desired direction. Likewise, FIG. 4 illustrates an antenna application in which a single antenna 16 has the coating 3 applied to it in a predetermined manner. With the coating 3 being used in its active mode, the single antenna 16 can be utilized in either search or track modes. The coating 3 also can be used in a phased array antenna to provide search and track and to provide data for a simplified altitude determination. The coating 3 also may find application in conjunction with a variety of microwave components, the coating 3 again being used to enhance component operation.

Although the coating 3 may comprise a variety of materials, we have found that coatings employing a layer 6 of low density polyacetylene or other low density inert plastic, a layer 5 of polyactylene doped with arsenic pentafloride and a layer 4 of polyacetylene doped with sodium achieves significant incident wave reduction in accordance with the principles of the invention discussed above. As will be appreciated by those skilled in the art, polyacetylene can be substituted for example by polyparaphenylene, polyphenylene sulfide, or amorphous classical semiconductor deposits to reduce diffusion of dopants.

Numerous variations, within the scope of the appended claims, will be apparent to those skilled in the art in light of the foregoing description and accompanying drawings. Thus, while particular thicknesses are indicated as preferred, the thickness of the coating 3 may be varied in other applications of this invention. Likewise, a number of materials, provided that they meet the dielectric constant and conductivity parameters set forth above, may be utilized for the layers 4, 5 and 6. Although certain applications were illustratively described in the invention described above, the invention is not limited to those particular applications. As previously indicated, the layer 6, while described in conjunction with the preferred embodiment, need not be used with other applications of the coating 3. These variations are merely illustrative.

Having thus described the invention, what is claimed and desired to be secured by Letters Patent is:

1. An absorptive coating for reduction of the reflective cross section of a metallic surface, comprising:

a first layer of N dopant material of predetermined thickness, said N dopant material having an increasing conductivity from its boundary outboard of the metallic surface to the N dopant material boundary with the metallic surface, the dielectric constant of the material likewise increasing along the thickness of the N dopant material in a direction toward the boundary of the N dopant material with the metallic surface; and a second layer of P dopant material of predetermined thickness, said P dopant material having an increasing conductivity from its boundary outboard of the metallic surface to its boundary with the N dopant material, said P dopant material having a generally increasing dielectric constant along its thickness in a direction toward its boundary with the N dopant material.

2. The coating of claim 1 further including a third layer of material outboard of the second layer, said third layer having a very small conductivity characteristic and a dielectric constant which increases with material thickness from its outboard boundary to its boundary with said second layer.

3. The coating of claim 2 wherein said third layer has approximately zero conductivity and a dielectric constant which increases from a low value at its outboard boundary to a high value at its boundary with the second layer.

4. The coating of claim 3 wherein said third layer comprises a coating of undoped polyacetylene or other low density plastic material.

5. The coating of claim 1 wherein said second layer is a P doped material having a conductivity increasing from a small value to a large value in a direction from its outboard boundary toward its boundary with said first layer, and a dielectric constant that increases with the thickness of said second layer.

6. The coating of claim 5 wherein said second layer is polyacetylene doped with arsenic pentafloride, for example.

7. The coating of claim 6 wherein said first layer is an N doped material having a conductivity approaching a metal at its boundary with the metal surface supporting said coating and a dielectric constant that increases with the thickness of said first layer.

8. The coating of claim 7 wherein said first layer is polyacetylene doped with sodium.

9. In a system employing a reflective surface for reflecting incident electromagnetic wave energy, the improvement comprising absorptive coating for reducing the reflection of incident waves from the reflective surface, said coating including a first layer of N doped material of predetermined thickness, said N doped material having an increasing conductivity from its boundary outboard of the reflective surface to the N dopant boundary with the reflective surface, the dielectric constant of the material likewise increasing along the thickness of the N doped material in a direction toward the boundary of the N doped material with the reflective surface and a second layer of P doped material of predetermined thickness, said P doped material having an increasing conductivity from its boundary outboard of the reflective surface to its boundary with the N dopant material, said P doped material having a generally increasing dielectric constant along its thickness in a direction toward its boundary with the N doped material.

10. The improvement of claim 9 further including a third layer of material outboard of the second layer, said third layer having a dielectric constant which increases with material thickness from its outboard boundary to its boundary with said second layer.

11. The improvement of claim 10 wherein said third layer has approximately zero conductivity and a dielectric constant which increases from a low value at its outboard boundary to a matching value at its boundary with the second layer.

12. The improvement of claim 11 wherein said third layer comprises a coating of undoped low density plastic.

13. The improvement of claim 9 wherein said second layer of P doped material has a conductivity which increases from a small value to a large value in a direction from its outboard boundary toward its boundary with said first layer, and a dielectric constant that increases with the thickness of said second layer.

14. The improvement of claim 13 wherein said second layer is polyacetylene doped with arsenic pentafluoride.

15. The improvement of claim 14 wherein said first layer of N doped material has a conductivity approaching a metal at its boundary with the reflective surface supporting said coating and a dielectric constant that increases with the thickness of said first layer.

16. The coating of claim 15 wherein said first layer is polyacetylene doped with sodium.

17. The improvement of claim 9 wherein said reflective surface is the metallic skin of an aircraft.

18. The improvement of claim 9 wherein said reflective surface is the radome of enclosure for an electromagnetic wave source.

19. A coating for altering the reflective characteristic of a reflective surface, comprising:

a first layer of N doped material of predetermined thickness, said N doped material having an increasing conductivity from its boundary outboard of the reflective surface to the boundary of the N doped material with the reflective surface, the dielectric constant of the material likewise increasing along the thickness of the N doped material in a direction toward the boundary of the N doped material with the reflective surface; and a second layer of P doped material of predetermined thickness, said P doped material having an increasing conductivity from its boundary outboard of the reflective surface to its boundary with the N doped material, said P doped material having a generally increasing dielectric constant along its thickness in a direction toward its boundary with the N doped material.

20. The coating of claim 1 wherein the boundary between said P dopant material and said N dopant material forms a PN junction, further including means for inserting an electrical signal across said PN junction.

21. The coating of claim 20 wherein said means for inserting an electric signal across said PN junction comprises means for generating an electrical voltage, and conductor means for electrically connecting said electrical voltage to respective ones of said P and said N layer material.

* * * * *